US009095904B2

(12) United States Patent
Balogh et al.

(10) Patent No.: US 9,095,904 B2
(45) Date of Patent: Aug. 4, 2015

(54) TITANIUM METAL POWDER PRODUCED FROM TITANIUM TETRACHLORIDE USING AN IONIC LIQUID AND HIGH-SHEAR MIXING

(75) Inventors: Michael P. Balogh, Novi, MI (US); Ion C. Halalay, Grosse Pointe Park, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 318 days.

(21) Appl. No.: 13/611,017

(22) Filed: Sep. 12, 2012

(65) Prior Publication Data

US 2014/0069233 A1 Mar. 13, 2014

(51) Int. Cl.
*C22B 34/12* (2006.01)
*B22F 9/24* (2006.01)

(52) U.S. Cl.
CPC ..... *B22F 9/24* (2013.01); *C22B 34/1272* (2013.01); *B22F 2009/245* (2013.01)

(58) Field of Classification Search
None
See application file for complete search history.

(56) References Cited

U.S. PATENT DOCUMENTS 3,977,866 A * 8/1976 Othmer ..... 75/617
5,779,761 A * 7/1998 Armstrong et al. ..... 75/370
7,169,285 B1 * 1/2007 O'Grady et al. ..... 205/367
7,455,713 B1 11/2008 Halalay et al.

* cited by examiner

*Primary Examiner* — George Wyszomierski
(74) *Attorney, Agent, or Firm* — Reising Ethington P.C.

(57) ABSTRACT

Titanium tetrahalide (preferably titanium tetrachloride) is reduced to titanium metal particles by reaction with an alkali metal dispersed in a non-aqueous, organic ionic liquid. The dispersion is enhanced using high-shear mixing. By-product alkali metal chloride salt(s) is dissolved in the ionic liquid. Precipitated titanium metal powder is readily separated from the ionic liquid solution as a product. And the separated solution may be subjected to electrolysis to recover chlorine gas, electrodeposited alkali metal, and the ionic liquid. Other metal halides may be added with the titanium halide to form titanium-based alloys or other titanium based products.

7 Claims, 1 Drawing Sheet

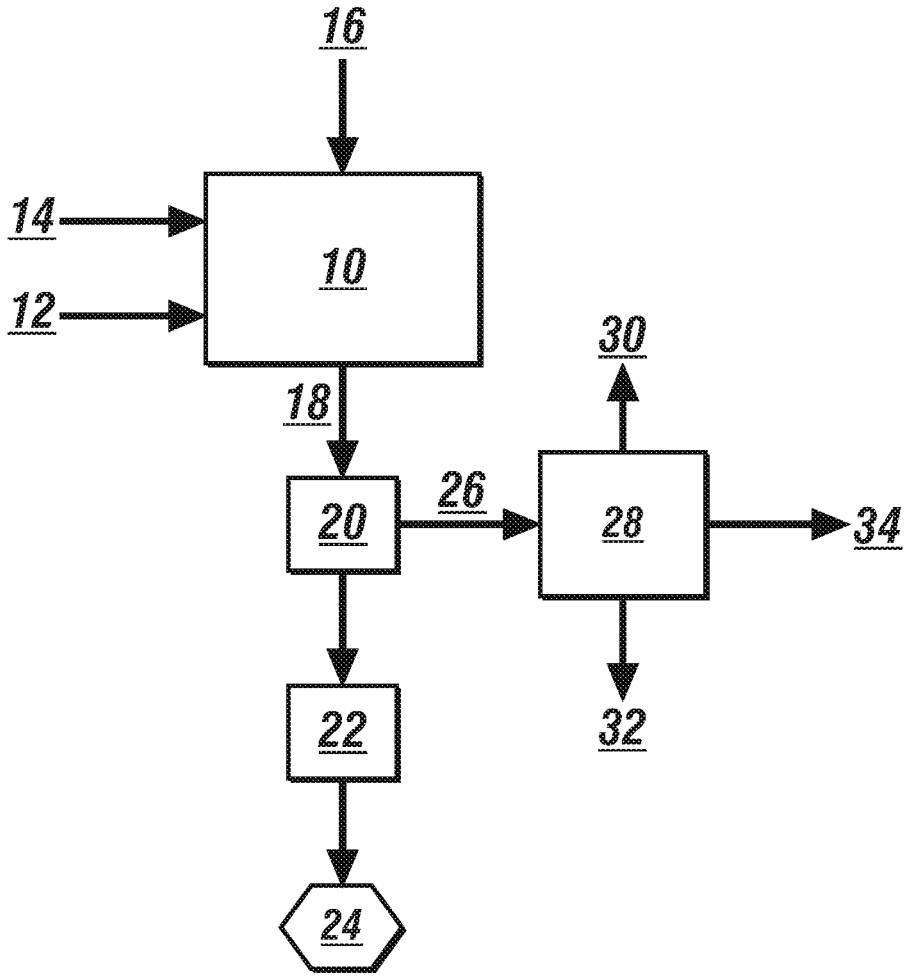
16
14
10
12
30
18
20
26
28
34
22
32
24

TITANIUM METAL POWDER PRODUCED FROM TITANIUM TETRACHLORIDE USING AN IONIC LIQUID AND HIGH-SHEAR MIXING

TECHNICAL FIELD

This invention pertains to close-to-ambient temperature preparation of titanium metal powder from titanium chloride (or other suitable titanium halide) using an anhydrous, organic, room temperature ionic liquid medium. Suitable alkali or alkaline earth metals are dispersed as a separate phase in the liquid medium, preferably using high speed shear-mixing, for reduction of titanium tetrachloride. The alkali metal and titanium tetrachloride are separate reacting phases that are dispersed as small, intimately mixed masses in the ionic liquid.

BACKGROUND OF THE INVENTION

Titanium and its metal alloys are examples of materials that are currently expensive to produce. Titanium alloys can be used in forms such as castings, forgings, and sheets for preparing articles of manufacture. Titanium based materials can be formulated to provide a combination of good strength properties with relatively low weight. For example, titanium alloys are used in the manufacture of airplanes. But the usage of titanium alloys in automotive vehicles has been limited because of the cost of titanium compared to ferrous alloys and aluminum alloys with competitive properties.

Titanium-containing ores are beneficiated to obtain a suitable concentration of $TiO_2$. In a Chloride Process, the titanium dioxide (often in the rutile crystal form) is chlorinated in a fluidized-bed reactor in the presence of coke (carbon) to produce titanium tetrachloride ($TiCl_4$), a volatile liquid at room temperature. Traditionally, metallic titanium was produced in batch processes from the high temperature reduction of titanium tetrachloride ($TiCl_4$) with sodium or magnesium metal. The first, and still the most widely used, process for producing titanium metal on an industrial scale is the Kroll Process. In the Kroll Process, magnesium at 800° C. to 900° C. is used as the reductant for $TiCl_4$ vapor and magnesium chloride is produced as the byproduct. This process produces titanium sponge and necessitates repetitive, energy intensive, vacuum arc remelting steps for purification of the titanium. The Kroll process can be used for the co-production of titanium and one or more another metals (an alloy) when the alloying constituent can be introduced in the form of a suitable chloride salt (or other suitable halide salt) that undergoes the sodium or magnesium reduction reaction with the titanium tetrachloride vapor. These high temperature and energy-consuming processes yield good quality titanium metal and metal alloys. But, as stated, these titanium materials are too expensive for many applications such as in components for automotive vehicles.

The Armstrong/ITP process also uses alkali metals or alkaline earth metals to reduce metal halides in the production of metals. The Armstrong process can run at lower temperatures and can operate as a continuous process for producing a metal or metal alloy (such as titanium or titanium alloy) powder. However, the projected cost of the metal is still high, too high for many automotive applications.

A lower cost process is needed for the production of titanium metal and titanium-based metal alloys.

SUMMARY OF THE INVENTION

In accordance with practices of the invention, titanium metal may be produced by reduction of a titanium halide (for example, and preferably, titanium tetrachloride, $TiCl_4$) with an alkali metal as these reactants are dispersed as fine particles or liquid droplets in an ionic liquid reaction medium. The reduction reaction may be conducted at close-to-ambient temperatures and at close-to-atmospheric pressure and produces titanium particles and alkali metal chlorides. It is noted that the process may also be used to simultaneously reduce other precursor chlorides (or other halides with a titanium halide to produce mixtures, alloys or compounds of titanium, titanium metal matrix composite materials, or the like.

The reductant for the precursor halide(s) is suitably one or more of the alkali or alkaline earth metals such as lithium, sodium, potassium, rubidium, cesium, magnesium, calcium, and barium. It is convenient and inexpensive to use one or both of potassium and sodium as the reductant for titanium tetrachloride. A particularly useful liquid reductant is a low-melting point mixture of the reactants that can be dispersed, by application of high shear mixing to the liquid, as colloidal bodies in the liquid medium at a near-to-ambient temperature. For example, eutectic mixtures of sodium and potassium, such as a mixture of 22 weight percent sodium and 78 weight percent potassium and a mixture of 44 weight percent sodium and 56 weight percent potassium, are liquid at about room temperature and are effective reductants for precursor titanium halides. A titanium halide and, optionally, one or more other precursor halides are then added to the reaction medium, with its dispersed reductants, and reduced to a predetermined product. The product may be titanium metal or a mixture of titanium and other metals, or titanium containing alloy, or a titanium compound, or the like.

The ionic liquid is an anhydrous organic compound (a salt) that is liquid at normal room temperature. Many suitable ionic liquid compounds for use in the practice of this invention are characterized by the presence of nitrogen atoms that provide ionic centers as nitrogen-containing cations or nitrogen-containing anions. An example of a suitable ionic liquid is a compound of N-methyl, N-propyl-piperidinium cations and bis(trifluoromethane sulfonyl) imide anions. Other suitable ionic liquids will be disclosed below in this specification. This organic ionic liquid salt is anhydrous and serves for intimate suspension of the reactants which comprise fine liquid droplets of titanium tetrachloride and particles or droplets of the alkali metal or mixed alkali metals. The suspension of these undissolved reactants in the ionic liquid may be accomplished using a suitable high speed, high-shear mechanical mixer to aggressively stir the multiphase mixture and promote reaction between the separate phases of titanium tetrachloride and alkali metal. The liquid reaction medium may be infused or covered with substantially oxygen-free and water-free inert gas such as argon or helium to provide an inert gas during the titanium-producing reaction.

The reaction proceeds at temperatures in the range of about 20° C. to about 100° C. Some heating of the stirred suspension may be used to start the mildly exothermic reaction.

As stated, suitable mixing of the ionic liquid reaction medium and undissolved reactants is accomplished using a high-shear mechanical mixing device. Such a device typically includes one or more rotors or impellers complemented in close proximity to stators which are used in this reaction to provide mixing of fine bodies of the titanium chloride and alkali metal material. The mother liquid and suspended reactants are stressed between a rotor and stator to achieve high-shear mixing. The reaction of the suspended globules or particles of matter in the ionic liquid may be conducted in a suitable batch reaction vessel or in a flow passage for a generally continuous reactor arrangement. In a batch-type reactor, for example, a selected charge of the alkali metal reductant may be added to the ionic liquid at the start of a reaction and the titanium tetrachloride liquid progressively added to the reaction medium. In general the reduction of the titanium halide with the alkali metal proceeds to completion. And it is usually preferred to use chemically equivalent proportions of the reactants to obtain a purer titanium product and to reduce costs.

Elemental titanium metal particles are produced, or a combination of titanium with other elements depending on the halide precursors added to the organic ionic liquid suspension medium. Alkali metal halides such as sodium chloride or potassium chloride are produced as by-products of the reduction reaction. But the ionic liquid is chosen to dissolve the alkali metal halides and facilitate easy subsequent electrochemical recovery of the alkali or alkaline earth metals and the halogen. The titanium particles are readily filtered from the ionic liquid and dissolved alkali metal halides. The titanium particles are easily purified and ready for use.

As will be described in more detail in the following specification, the ionic liquid, with its dissolved alkali metal halide content, provides the basis for electrolysis of the medium to recover electroplated elemental alkali metal(s) starting material and the halogen as a gas. Both materials may be re-used in an overall titanium process that may start with a titanium oxide (for reaction with the recovered halogen gas to produce more $TiCl_4$ as a starting material for production of more titanium metal by the process of this invention. Thus, the use of a suitable organic ionic liquid for the reaction medium and dissolution of by-product alkali metal halides provides a basis for a very efficient and relatively low cost preparation of titanium metal (or of titanium-containing materials).

Other objects and advantages of the invention will be apparent from the following disclosures of illustrative practices.

BRIEF DESCRIPTION OF THE DRAWINGS

The drawing FIGURE is a schematic process flow diagram for illustration of the production of titanium metal by reacting liquid titanium tetrachloride at a temperature below about 50° C. with an alkali metal dispersed in a room temperature ionic liquid. In a preferred embodiment, the dispersion of alkali metal and titanium tetrachloride in the ionic liquid is maintained using a suitable high shear mixing apparatus.

DESCRIPTION OF PREFERRED EMBODIMENTS

In accordance with this disclosure, practices are described and illustrated for producing titanium metal by co-dispersing liquid titanium tetrachloride and solid or liquid alkali metal in a non-aqueous, room temperature ionic liquid composed of organic cations and anions. In some preferred embodiments the co-dispersion is enhanced using high shear rate stirring. The reaction is thus conducted at generally ambient temperatures or at temperatures of about 20° C. to about 50° C. Titanium metal is produced as the product which readily separates from the ionic liquid, and alkali metal chloride (or other halide) is formed as a by-product which disperses or dissolves in the ionic liquid. The dispersion of alkali metal in the ionic organic liquid is recovered from the titanium reactor and, in many embodiments of the invention, subjected to electrolysis to recover both chlorine gas and electroplated alkali metal.

During the following description of an illustrative practice of the invention, reference will be made to the drawing FIGURE which is a schematic flow diagram of a process for producing titanium metal from titanium tetrachloride and recovering the solvent and reductant used in the process. As described above in the Background section of this specification, titanium ore is often beneficiated to a suitable amount and quality of titanium dioxide in its rutile crystal form. The titanium dioxide is converted to titanium tetrachloride ($TiCl_4$). $TiCl_4$, a volatile liquid at normal room temperatures, is suitably used as the source of titanium in practices of this invention. In the following illustration, the reduction of the titanium tetrachloride is conducted as a batch reaction. But the reduction reaction may be performed as a continuous reaction, or in other reaction modes.

A reaction vessel 10 is used in the relatively low temperature reduction of titanium tetrachloride with an alkali metal using a room temperature organic ionic liquid as a medium for dispersing both the alkali metal and titanium tetrachloride for the reduction reaction. The reaction is conducted in an environment that is substantially free of oxygen (or any oxidant) and water. So reaction vessel 10 is provided with means for initially purging its internal volume of air and moisture and for maintaining the reaction space under dry argon or other inert gas atmosphere.

A metallic reaction vessel (or glass-lined metallic vessel) may be used for the reduction reaction. The reaction vessel 10 is provided with heating and cooling means for maintaining the reaction mixture within a desired temperature range, typically from about 20° C. to about 50° C. Reaction vessel 10 is also adapted for the addition of a suitable volume of ionic liquid (flow stream 12 in the FIGURE) and the subsequent addition (flow stream 14) of sodium, or potassium, or a low melting eutectic of the alkali metals, as described above in this specification. The volume of ionic liquid serves as the dispersing medium for the separate phases of alkali metal and of titanium tetrachloride employed in the reduction reaction. The volume of ionic liquid also serves as a solvent for the alkali metal chloride salts produced in the reduction reaction, and as a suspending medium for the particles of titanium metal produced by the reduction of titanium tetrachloride.

Suitable ionic liquids are non-aqueous organic liquids that remain in the liquid state throughout the reduction reaction and are capable of dissolving the alkali metal chloride by-product of the reduction reaction. As described above, suitable ionic liquids are salt-like compounds of nitrogen-containing cations and nitrogen-containing anions. An example of a suitable ionic liquid is a compound of N-methyl, N-propyl-piperidinium cations and bis(trifluoromethane sulfonyl) imide anions. Other suitable cations (for use with bis(trifluoromethane sulfonyl) imide anions) include trimethyl propyl ammonium cations and 1-ethyl-3-methyl imidazolium cations. In addition to being capable of dissolving alkali metal chlorides, the by-product ionic liquid solutions will be separated from the precipitated titanium metal particles at the completion of the reaction, and subjected to electrolysis for the purpose of decomposing the alkali metal chlorides into chlorine gas and plated alkali metal for reuse in the production of titanium.

In accordance with preferred embodiments of this invention, reaction vessel 10 is provided with a high shear mixing apparatus for forming an intimate dispersion of the alkali metal reductant (introduced into reaction vessel 10 as flow stream 14) in the ionic liquid (introduced as flow stream 12). In some practices the high shear mixing apparatus comprises a closely spaced rotor and stator. The main ionic liquid volume, with its solid or liquid additions, is directed between a rapidly rotating rotor and its complementary stator. As the multiphase constituents are thus stressfully stirred, the alkali metal material is dispersed as small droplets or particles in the ionic liquid. In some preferred practices of this invention, a suitable dispersion of the alkali metal reductant is attained in the ionic liquid volume of the reaction vessel 10 before titanium tetrachloride is added to the reaction vessel. When the reductant is suitably dispersed a flow of liquid titanium tetrachloride (flow stream 16 in the FIGURE) is added at a suitable rate to the dispersed reductant in the ionic liquid. The temperature within reaction vessel 10 is initially set at a desired temperature and maintained within a suitable temperature range as the mildly exothermic reduction of titanium tetrachloride to titanium metal is conducted.

As titanium tetrachloride is added to the dispersed alkali metal reductant, the reduction reaction proceeds quickly in accordance with the following equation (where sodium is used as the reductant):

$$TiCl_4+4\ Na \rightarrow Ti+4\ NaCl.$$

It is preferred that the total amount of reductant dispersed in the ionic liquid be substantially chemically equivalent to the amount of titanium tetrachloride to be added to the batch titanium reactor 10. As the titanium metal is formed it is dispersed as fine solid particles in the ionic liquid, and the alkali metal halide is dissolved in the ionic liquid. Thus, at the completion of the addition of titanium tetrachloride, it is intended that substantially all the titanium tetrachloride and alkali metal reductant be consumed and that the remaining material in titanium reactor 10 be titanium metal particles and a solution of alkali metal chloride in the ionic liquid.

At the completion of the titanium reaction, the mixture of titanium metal particles and the ionic liquid are removed from the reactor (still in a dry and oxygen free-mode) as stream 18 and conducted to separator 20. In separator 20 the titanium particles are removed from the ionic liquid (such as by filtration). The separated titanium particles are moved to a cleaning stage 22 in which any residual ionic liquid, alkali chloride, or other materials are removed. The substantially pure titanium particles are indicated at stage 24 of the FIGURE.

The solution of sodium chloride or other alkali metal chloride is removed from separator 20 as flow stream 26. At a suitable time the recovered by-product solution is subjected to suitable electrolysis of the alkali metal chloride to recover each of chlorine gas (anode-based stream 30), alkali metal (cathode-based stream 32) as a plated solid, and re-usable ionic liquid (stream 34).

Thus, in accordance with practices of this invention, titanium metal is produced from titanium tetrachloride in an ambient temperature reduction process. Chlorine may be recovered for the production of more titanium tetrachloride or other use. And the ionic liquid, which enabled easy separation of the titanium product, is recovered for further use in titanium production.

Other halides of titanium may be used in the reduction reaction, such as a fluorides, bromides or iodides. But titanium tetrachloride is preferred because of its availability and relative ease of use.

As disclosed above, practices of this invention may also be used to prepare mixtures, alloys, or compounds of titanium using halides of other elements such as vanadium tetrachloride, carbon tetrachloride, silicon tetrachloride, platinum dichloride, aluminum trichloride, and zirconium tetrachloride.

The invention claimed is:

1. A method of producing titanium metal from titanium tetrachloride comprising:

dispersing solid particles or liquid droplets of an alkali metal in a non-aqueous, organic, room temperature ionic liquid, the non-aqueous, organic, room temperature ionic liquid comprising nitrogen-containing cations and nitrogen-containing anions;

adding a chemically equivalent amount of titanium tetrachloride to the dispersion of the alkali metal in the ionic liquid while maintaining the dispersion, the titanium tetrachloride reacting with the dispersed alkali metal to form particles of titanium metal that are not soluble in the ionic liquid and alkali metal chloride salt which is soluble in the ionic liquid; and separating the titanium metal particles from the solution of alkali metal chloride in the ionic liquid.

2. A method of producing titanium metal as recited in claim 1 in which the ionic liquid comprises one or more cations selected from the group consisting of N-methyl, N-propyl-piperidinium cations, trimethyl propyl ammonium cations and 1-ethyl-3-methyl imidazolium cations.

3. A method of producing titanium metal as recited in claim 1 in which the ionic liquid comprises bis (trifluoromethane sulfonyl) imide anions.

4. A method of producing titanium metal as recited in claim 1 in which the dispersion of solid particles or liquid droplets of an alkali metal in a non-aqueous, organic, room temperature ionic liquid is attained and maintained by subjecting the dispersion to mechanical shear-mixing between a rotating member and a stationary member.

5. A method of producing titanium metal as recited in claim 1 further comprising, after separation of the titanium metal particles from the solution of alkali metal chloride in the ionic liquid, subjecting the solution of alkali metal chloride to electrolysis to recover at least one of (i) chlorine gas, (ii) alkali metal, and (iii) the ionic liquid.

6. A method of producing titanium metal from a titanium tetrahalide comprising:

adding an alkali metal to a non-aqueous, organic, room temperature ionic liquid and using mechanical-shear mixing to disperse the alkali metal as finely divided separate phase in the ionic liquid, the non-aqueous, organic, room temperature ionic liquid comprising nitrogen-containing cations and nitrogen-containing anions;

adding a titanium tetrahalide to the dispersion of the alkali metal in the ionic liquid while continuing the mechanical-shear mixing, the titanium tetrahalide reacting with the dispersed alkali metal to form particles of titanium metal that are not soluble in the ionic liquid and alkali metal halide salt which is soluble in the ionic liquid, the addition of the titanium tetrahalide being continued until amount of titanium tetrahalide that is chemically equivalent to the alkali metal has been added; and separating the titanium metal particles from the solution of alkali metal halide in the ionic liquid.

7. A method of producing titanium metal as recited in claim 6 in which the titanium tetrahalide is titanium tetrachloride.

* * * * *